United States Patent [19]

Plucknett

[11] Patent Number: 4,545,543

[45] Date of Patent: Oct. 8, 1985

[54] YARN FEED DEVICE

[75] Inventor: Derek W. Plucknett, Leicester, England

[73] Assignee: Triplite Limited, Leicester, England

[21] Appl. No.: 601,170

[22] Filed: Apr. 17, 1984

[30] Foreign Application Priority Data

Apr. 27, 1983 [GB] United Kingdom ..... 8311503

[51] Int. Cl.[4] ..... B65H 51/20; D04B 15/48

[52] U.S. Cl. ..... 242/47.01; 66/132 T

[58] Field of Search ..... 242/47.01, 47.08, 47.09, 242/47.12, 47; 66/132 R, 132 T

[56] References Cited

U.S. PATENT DOCUMENTS

| | | | |
|---|---|---|---|
| 4,004,438 | 1/1977 | Raisin | 242/47.01 X |
| 4,147,311 | 4/1979 | Jordan | 242/47.01 |
| 4,457,144 | 7/1984 | Sawazaki | 66/132 T |
| 4,483,159 | 11/1984 | Cucconi et al. | 66/132 T |

FOREIGN PATENT DOCUMENTS

| | | | |
|---|---|---|---|
| 1635893 | 5/1973 | Fed. Rep. of Germany | 66/132 T |
| 2839454 | 3/1980 | Fed. Rep. of Germany | 242/47.01 |
| 2141482 | 1/1973 | France | 242/47.01 |
| 596351 | 1/1948 | United Kingdom . | |
| 657503 | 9/1951 | United Kingdom . | |
| 665476 | 1/1952 | United Kingdom . | |
| 1496632 | 12/1977 | United Kingdom . | |
| 1509309 | 5/1978 | United Kingdom . | |
| 2065723 | 6/1981 | United Kingdom . | |

*Primary Examiner*—Stanley N. Gilreath

*Attorney, Agent, or Firm*—Buell, Ziesenheim, Beck & Alstadt

[57] ABSTRACT

A capstan wheel yarn feed device for textile machinery. A yarn tension detector (26) is provided in the yarn path downstream of a yarn outfeed eye (24), and is effective to move a yarn infeed guide (20) axially of the capstan wheel (10) in response to the detected presence or absence of tension in the yarn (16) delivered from the wheel. In this way the yarn is physically moved axially of the wheel when yarn demand ceases, to a zone which is of smaller perimeter and which optionally has a lower frictional coefficient. This removes the tendency of the wheel to continue to feed the yarn after the demand has ceased. Preferably the yarn is also clamped (34, 36) at the yarn infeed side of the wheel as demand ceases.

10 Claims, 4 Drawing Figures

YARN FEED DEVICE

DESCRIPTION

The invention relates to yarn feed devices for textile machinery, employing a capstan wheel principle to ensure that the yarn is delivered to the machinery at a constant tension and at the rate demanded by the machinery.

Friction wheel yarn feed devices are well known and are particularly useful when the demand for yarn is intermittent, such as in knitting machines with striping mechanisms in which any of a number of alternative yarns can be fed to the knitting needles. In such machines, when a particular yarn is being knitted, the tension in the yarn between the friction wheel and the knitting needles is sufficient to draw the yarn into frictional engagement with the friction wheel so that the yarn is delivered by the wheel at a metered rate that is directly proportional to the speed of knitting. When the knitting of that yarn is terminated, its tension falls marginally at the outfeed side of the friction wheel, and this in theory is sufficient to release the frictional engagement of the wheel with the yarn, so that the wheel thereafter turns freely without driving the yarn forward.

In the above friction wheel yarn feed devices the yarn is in contact with the wheel for only one part of one turn. In practice the performance of such devices is dependent on the yarn used. For some yarns the above theoretical ideal of performance is achieved, but for others either there is slippage between the wheel and the yarn at all times or the frictional engagement between the yarn and the wheel continues even after demand for the yarn at the outfeed side of the wheel ceases. For this reason the conventional friction wheel yarn feed devices are generally sold as yarn feed assist devices rather than positive feed devices. One such yarn feed assist device is provided with means to vary the angular extent of contact between the yarn and the wheel in the feeding and non-feeding modes. This is sufficient to cure the problem of continued feeding of the yarn after demand ceases, but not that of slippage between the wheel and the yarn.

Other friction wheel yarn feed assist devices have been proposed in which the feeding of yarn is continuous rather than intermittent. One such yarn feed assist device is disclosed in British Pat. No. 657503 and comprises a turn of yarn in frictional contact with about 270° of a tapered roller. The yarn is moved automatically to a roller diameter which is determined as a function of yarn tension, although in the case of overfeed or yarn breakage a stopmotion device is actuated to stop the textile machinery and yarn feed device. This friction wheel yarn feed assist device cannot therefore function when yarn demand is intermittent.

There is therefore a clear need for a yarn feed device which, for all types of yarn, engages into a positive feed mode automatically on yarn demand and reliably disengages automatically on termination of that demand. The present invention fulfills that need.

The invention provides a yarn feed device for textile machinery, comprising a capstan wheel for receiving a number of turns of yarn, means associated with the wheel for axially separating successive turns of yarn on the wheel, a yarn infeed guide for guiding the delivery of yarn to the wheel, a yarn outfeed guide for guiding the delivery of yarn from the wheel, a yarn tension and overfeed detector in the yarn path downstream of the yarn outfeed guide for distinguishing between the existence of and the absence of yarn tension in yarn delivered from the wheel, and means responsive to the yarn tension and overfeed detector for moving the yarn infeed guide axially of the wheel in response to a detected presence or lack of tension in the yarn delivered from the wheel, to move the yarn turns on the wheel from a first axial zone in which the yarn is positively fed by the wheel when the yarn tension and overfeed detector senses a yarn tension, to a second axial zone in which the yarn is neither positively fed nor assisted by the wheel when the yarn tension and overfeed detector senses no yarn tension.

The yarn tension and overfeed detector used in the device of the invention is a detector which is tension-sensitive but which acts to compensate for the overfeed of yarn, taking up the slack generated when the yarn outfeed tension falls to zero as it does when demand for yarn ceases even though the textile machinery and therefore the capstan wheel continues to operate.

This specification distinguishes between friction wheel yarn feed devices generally and capstan wheel yarn feed devices. This invention is concerned only with true capstan wheel yarn feed devices, in which the yarn passes around the wheel for more than one complete turn of 360°.

All capstan wheel yarn feed devices employ means for separating successive yarn turns on the wheel to prevent yarn interference. Preferably the yarn feed device according to the invention employs for this purpose a smooth upstanding guide member, such as a pin, alongside the wheel and inclined at an angle to the axis of the wheel. The angle is preferably variable. Axial movement of the infeed and optionally the outfeed guide when the output tension falls to zero (i.e. when the demand for the yarn ceases) causes the yarn turns to move bodily along the wheel to an axial location at which the guide member is closer to the wheel, and this results in slackening of the yarn turns around the wheel. As a result, frictional engagement between the yarn and the wheel is reduced so that the wheel turns freely within the turns of yarn.

The invention proposes for the first time means whereby the turns of yarn can be moved axially of a capstan wheel automatically to engage or disengage positive feed in response to yarn demand by associated textile machinery. Such an axial movement in a direction to disengage positive feed advantageously is to a portion of the wheel of smaller effective diameter, which in addition or as an alternative to the inclination of the guide member referred to above causes a slight fall in the tension of the yarn turns around the wheel, which more effectively causes cessation of the positive feeding of the yarn when the demand ceases.

Movement of the yarn turns in the reverse direction, to re-engage positive feed, involves movement of the yarn turns up a step in the wheel from the portion of smaller diameter to the portion of larger diameter. Normally this would be impossible on a capstan wheel, but it is made possible by the use of the smooth upstanding guide member referred to above. This member lifts each turn of yarn from the wheel and lays it back on the wheel at a slightly different angle, and this action is quite sufficient to ensure smooth and consistent movement of the yarn turns between the zones of different diameter, in both directions, while maintaining uniform separation of adjacent turns of the yarn.

The yarn feed device according to the invention advantageously further provides a clamping means, responsive to the yarn tension and overfeed detector, for clamping the input yarn when the detected tension of the yarn delivered by the wheel falls to zero. Advantageously the clamping is automatic as the yarn outfeed tension falls to zero, this conveniently being achieved when the clamping means comprises a magnet arranged to attract a leaf spring, so as to clamp the yarn between the spring and the magnet only when the yarn infeed guide is in its position corresponding to the detected zero yarn delivery tension.

In the case of a yarn feed device for a striper unit of a circular knitting machine, for example, the demand for each yarn is intermittent and while there is no demand for a given yarn that yarn would also be clamped at the striper feed unit itself, downstream of the yarn feed device. As a result, cessation of demand for a yarn would provide that the yarn is clamped in two places: by the above clamping means at the inlet side of the yarn feed device and by the striper unit on the yarn outlet side. This provides a more complete yarn control than ever considered feasible, since the yarn feed device is totally isolated from both the yarn package and the textile machinery until the textile machinery again demands a supply of yarn.

A further advantage of the invention can be achieved by creating, on the surface of the capstan wheel, zones of different frictional characteristics. Yarn is fed to the first axial zone, having a higher frictional characteristic, when there is a demand for the yarn. Cessation of that demand, with the resultant loss of tension of the yarn delivered from the wheel, causes the yarn infeed guide to move axially of the wheel to deliver the yarn exclusively to the second axial zone, having a lower frictional characteristic. As a result it has surprisingly been found that the number of turns of yarn around the wheel can be dramatically reduced (for example, to as little as 2 or 3 turns for some yarns) while maintaining true positive capstan feed when yarn is demanded by the textile machine and reliably terminating the yarn delivery when that demand ceases.

DRAWINGS

Figure 1:
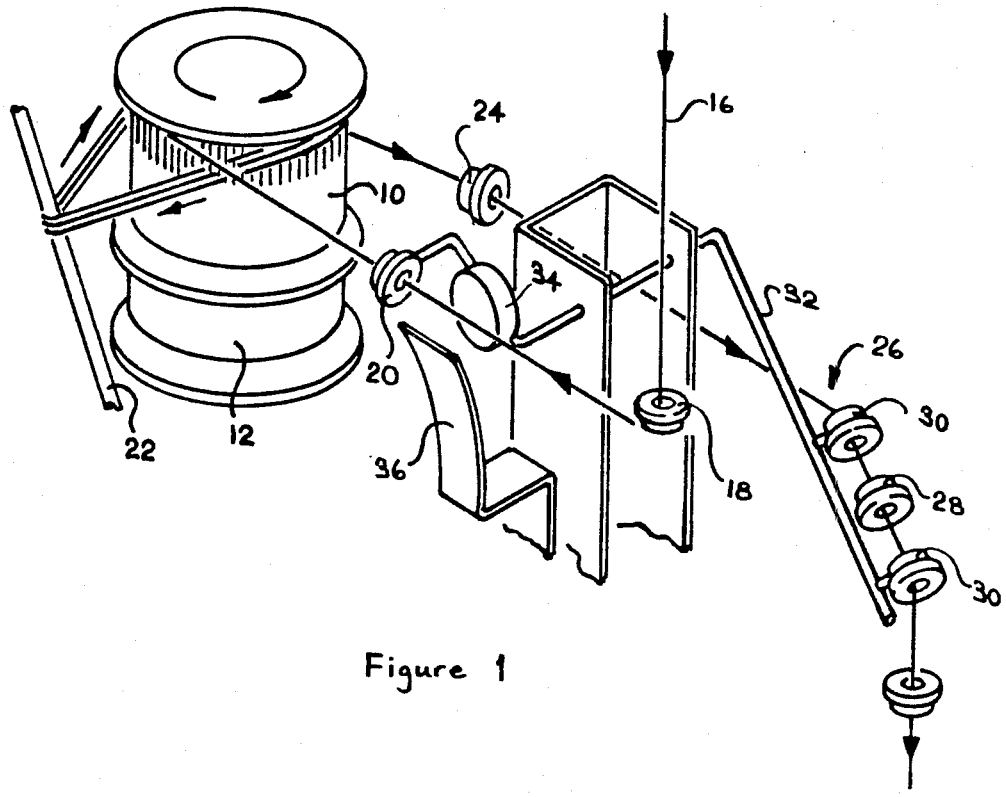
FIGS. 1 and 2 are perspective views of a yarn feed device according to the invention in its two alternative operating conditions, corresponding to knitting and non-knitting of the yarn respectively.
Figure 3:
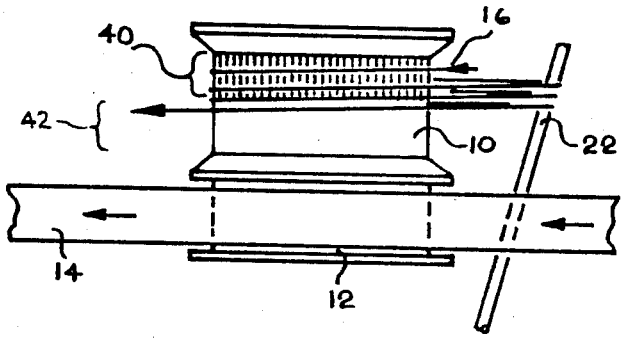
FIG. 3 is a front elevation of the device in the condition of FIG. 1.
Figure 2:
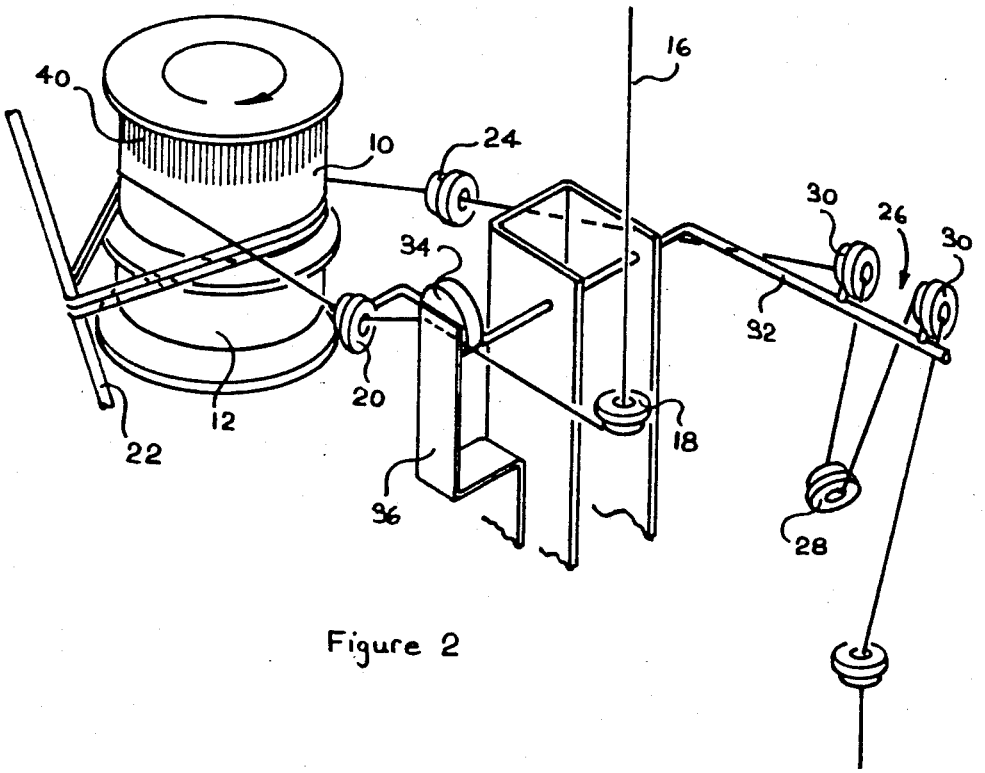

The yarn feed device illustrated in FIGS. 1 to 3 comprises a single capstan wheel 10 mounted on a drive wheel 12 which in use is driven by a belt 14 (FIG. 3) at a speed directly related to the speed of the knitting machine or other textile machine which the yarn feed device supplies. Typically the same belt passes around the drive wheels of a number of similar feed devices each supplying yarn to a knitting station of the knitting machine.

It will be understood that when the yarn feed device of the invention is intended to supply any of a number of different yarns to a striping mechanism of a knitting machine, then one capstan wheel 10 would be provided for each such yarn. Each capstan wheel would be a part of a similar yarn feed device, all identical to that illustrated in the drawings except that the plural capstan wheels could be stacked coaxially on a single drive wheel 12.

Reverting to the single capstan wheel device illustrated in the drawings, a yarn 16 is shown being fed from a yarn package (not illustrated) through an eyelet 18 and a yarn infeed eyelet 20, around the capstan wheel 10 and a guide finger 22, to an outfeed eyelet 24. From the outfeed eyelet 24 the yarn passes through a tension and overfeed detector 26, whence it is delivered to the textile machine (not shown).

The tension detector 26 comprises a fixed eyelet 28 and a pair of eyelets 30 on a wire lever 32 which can move pivotally between the positions shown in FIGS. 1 and 2. The wire lever 32 is lightly biased to the position of FIG. 2 by a permanent magnet 34 optionally assisted by a counerbalance weight (not shown). The magnet 34 in the position of FIG. 1 is spaced sufficiently above the level of a leaf spring 36 that it does not overcome the resilience of the leaf spring. However, when the wire lever 32 is in the position shown in FIG. 2 the magnet 34 is lowered into alignment with the top portion of the leaf spring 36, so that it overcomes the resilience of the spring and holds the spring against the face of the magnet. The yarn guide eyes 18 and 20 are so aligned that the yarn 16 is clamped between the magnet 34 and the spring 36 when the lever 32 is in the positiion shown in FIG. 2.

If desired, a horizontal pin or ledge may be provided between the yarn inlet guide eye 20 and the wheel 10, so as to limit the downward axial movement of the yarn turns on cessation of yarn demand.

In use, when there is demand for the yarn 16 at the textile machine, the slight tension at the yarn outfeed side of the capstan wheel 10 is sufficient to maintain the lever 32 in the position of FIG. 1. The same tension draws the yarn against the wheel 10, ensuring that the wheel operates as a capstan and delivers yarn at a rate directly proportional to the speed of the machine. Thus although the yarn is delivered under slight tension, this is maintained constant and is in general considerably less that the tension at the infeed side of the capstan wheel which fluctuates as the yarn is withdrawn from its package.

When the demand for the yarn 16 ceases, for example when the textile machine switches to another yarn, there is an initial overfeed of yarn by the capstan wheel 10. The yarn tension at the outfeed side of the wheel 10 falls to zero, and the overfed yarn is drawn into a loop by the light bias on the wire lever 32 caused by the counterweight.

The movement of the wire lever 32 has three results. The first is that the yarn is drawn into a loop as above described. The second is that the infeed eye 20, which is mounted on the lever 32, is lowered so as to move the yarn turns down the wheel 10 and guide finger 22. The third is that the yarn fed to the wheel becomes trapped or lightly clamped between the leaf spring 36 and the magnet 34.

The lowering of the infeed eye 20 causes the yarn turns to fall on the wheel 10 until they occupy an axial zone (FIG. 2) lower than that orginally (FIGS. 1 and 3). It will readily be seen from FIG. 3 that the inclination of the guide finger 22 is such that the yarn turns slacken as they fall, which encourages the free rotation of the wheel 10 within the yarn turns with immediate and almost total loss of the capstan effect.

A further measure of yarn control is achieved by having a first axial zone 40 of the wheel 10 formed with a textured surface, which has a higher coefficient of friction than the remainder of the wheel which forms a second axial zone 42. When the yarn is being demanded by the textile machine and the lever 32 is in the position shown in FIG. 1 the yarn is on this textured surface 40 (FIG. 3) to impart a strong positive feed to the yarn. When the lever 32 is in the position shown in FIG. 2 the turns of yarn around the wheel 10 and guide finger 22 are all in the zone 42 below the zone 40, which allows the wheel 10 to turn without driving the yarn forward.

It will be understood that the capstan surface of the wheel 10 may be continuous as illustrated or that the capstan surface may be provided by a circular array of discrete pins each having substantially point contact with the yarn. If the latter construction of wheel is chosen, then the differential friction surface may be obtained by surface-treating a short axial length of each pin of the array before assembly, to provide a first axial zone 40 of higher friction.

It will further be understood that the capstan surface of the wheel 10 may be cylindrical or stepped. If the latter, the yarn is fed to the larger diameter portion when there is a demand for the yarn from the textile machine, and to the smaller diameter portion when the demand ceases. The larger diameter portion thus corresponds to the first axial zone 40 of FIGS. 2 and 3 and the smaller diameter portion corresponds to the second axial zone 42. The difference in diameter between the two portions need only be very slight in order to assure adequate slackening of the yarn turns as they fall.

Figure 4:
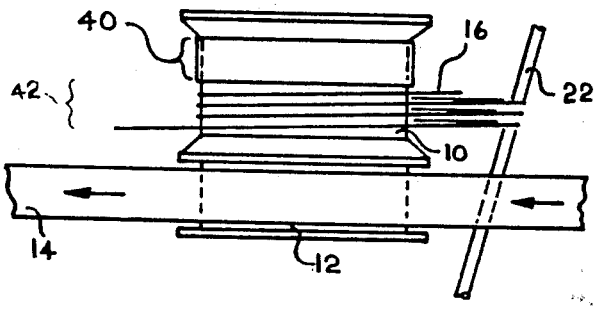
FIG. 4 is a front elevation, similar to that of FIG. 3, of an alternative yarn feed device according to the invention.

FIG. 4 illustrates such a stepped capstan surface of the wheel 10. The same reference numerals are used in FIG. 4 as in FIGS. 1 to 3, so that only the relevant differences between the two embodiments need be described further. In FIG. 4, the first axial zone 40 is provided by the outer surface of a rubber band placed around an otherwise constant diameter wheel 10, and the second axial zone 42 is provided by the unclad wheel surface. Thus the rubber band provides, at the same time, both the different diameters and the different frictional characteristics of the first and second zones 40 and 42.

I claim:

1. A yarn feed device for intermittent positive feeding of yarn to textile machinery, comprising:

a capstan wheel for receiving a number of turns of yarn, means for driving the capstan wheel at a speed synchronized with that of the textile machinery, spaced first and second axial locations on said capstan wheel having different yarn engaging characteristics, a yarn infeed guide for guiding the delivery of the said yarn to the capstan wheel, a yarn outfeed guide for guiding the delivery of the said yarn from the capstan wheel, means associated with the capstan wheel for axially separating successive turns of the said yarn on the wheel, a yarn tension and overfeed detector in the yarn path of the said yarn downstream of the yarn outfeed guide, comprising movable yarn guide means and means lightly biasing the movable yarn guide means to draw a compliance loop in the said yarn downstream of the yarn outfeed guide to take up yarn overfed by the capstan wheel when the yarn demand by the textile machinery falls, and pivotal lever means connecting the yarn infeed guide to the movable yarn guide means of the yarn tension and overfeed detector, for progressively moving the yarn infeed guide axially of the wheel in response to movement of the movable yarn guide means, whereby the yarn turns are positioned at said first axial location on the capstan wheel resulting in positive feed of the said yarn by the wheel when the yarn tension and overfeed detector senses a yarn tension in the said yarn downstream of the yarn outfeed guide sufficient to exhaust the compliance loop in the said yarn, indicating that a demand for the yarn exists, and whereby the yarn turns are positioned at said second axial location on the wheel resulting in free movement of the wheel within the yarn turns when the compliance loop of yarn is fully drawn, indicating that there is no demand for the yarn.

2. A yarn feed device according to claim 1, wherein the means associated with the wheel for axially separating successive turns of yarn on the wheel comprises a smooth-sided upstanding member alongside the wheel for lifting each turn of yarn out of contact with the wheel for a small part of each 360° arc of contact between the yarn and wheel, the yarn turns being freely movable axially of the upstanding member.

3. A yarn feed device according to claim 1, wherein the yarn infeed guide is located on the opposite side of the pivotal axis of the pivotal lever means, and closer to the pivotal axis, than the movable yarn guide means of the yarn tension and overfeed detector.

4. A yarn feed device according to claim 1, further comprising:

clamping means, actuable and releasable automatically in response to movement of the pivotal lever means, for clamping the yarn immediately upstream of the yarn infeed guide when the pivotal lever means is at a pivotal position in which the compliance loop of yarn is fully drawn.

5. A yarn feed device according to claim 4, wherein the clamping means comprises a magnet and a magnetizable member, the magnet being carried on the pivotal lever means and being movable into alignment with the magnetizable member and with the yarn path to the yarn infeed guide, thereby to attract the magnetizable member onto the magnet and to clamp the yarn therebetween, in response to the pivotal movement of the lever means to the position in which the movable yarn guide means fully draws its compliance loop of yarn.

6. A yarn feed device according to claim 1, wherein the first axial location on the wheel has a higher frictional characteristic than the second axial location.

7. A yarn feed device according to claim 2, wherein the first axial location on the wheel has a larger circumference than the second axial location, the boundary between the two axial locations being provided by a discrete step in the wheel diameter.

8. A yarn feed device according to claim 7, wherein the discrete step in the wheel diameter is provided by a rubber sleeve placed around an otherwise constant diameter wheel, the first axial location being provided by the rubber sleeve outer surface and having a higher frictional characteristic than the second axial location.

9. A yarn feed device for textile machinery comprising a constantly driven feed wheel receiving a number of turns of yarn, wherein the yarn feed is switchable between positive feed and no yarn feed as a function of sensed yarn tension at an outfeed side of the feed device, which yarn feed device comprises:

a yarn infeed guide for guiding yarn onto the feed wheel, a yarn outfeed guide for guiding yarn from the feed wheel, a rubber-covered axial zone on the feed wheel, having a larger diameter and higher frictional characteristic than the remainder of the feed wheel, a yarn tension detector at an outfeed side of the feed wheel, in the yarn path downstream of the yarn outfeed guide, the said yarn tension detector comprising fixed and movable yarn guide means and means lightly biasing the movable yarn guide means to a limiting position out of alignment with the fixed yarn guide means so that yarn passing through the said yarn guide means follows a first yarn path with the said fixed and movable yarn guide means in alignment when demand for the yarn exists at the textile machinery to tension the yarn at the outfeed side of the feed wheel, and yarn passing through the said yarn guide means follows an extended yarn path with the said fixed and movable yarn guide means out of alignment demand for the yarn by the textile machinery falls, and lever means mounting the yarn infeed guide and the movable yarn guide means, for moving the yarn infeed guide axially of the feed wheel in response to the movement of the movable guide means from its first position in alignment with the fixed yarn guide means to its limiting position, for positioning yarn turns on the feed wheel selectively on the rubber-covered axial zone to establish positive feed when the movable yarn guide means of the yarn tension detector in its said first position and selectively on another zone permitting free rotation of the wheel relative to the yarn turns when the movable yarn guide means of the yarn tension detector is in its limiting position out of alignment with the fixed yarn guide means, the movement of the yarn infeed guide by the lever means being a progressive movement corresponding to the progressive movement of the movable yarn guide means.

10. A yarn feed device for textile machinery comprising a constantly driven feed wheel receiving a number of turns of yarn, wherein the yarn feed is switchable between positive feed and no yarn feed as a function of sensed yarn tension at an outfeed side of the feed device, which yarn feed device comprises:

a yarn infeed guide for guiding yarn onto the feed wheel, a yarn outfeed guide for guiding yarn from the feed wheel, a rubber-covered axial zone on the feed wheel, having a larger diameter and higher frictional characteristic than the remainder of the feed wheel, a yarn tension detector at an outfeed side of the feed wheel, in the yarn path downstream of the yarn outfeed guide, the said yarn tension detector comprising fixed and movable yarn guide means and means lightly biasing the movable yarn guide means to a limiting position out of alignment with the fixed yarn guide means so that yarn passing through the said yarn guide means follows a first yarn path with the said fixed and movable yarn guide means in alignment when demand for the yarn exists at the textile machinery to tension the yarn at the outfeed side of the feed wheel, and yarn passing through the said yarn guide means follows an extended yarn path with the said fixed and movable yarn guide means out of alignment when demand for the yarn by the textile machinery falls, lever means mounting the yarn infeed guide and the movable yarn guide means, for moving the yarn infeed guide axially of the feed wheel in response to movement of the movable guide means from its first position in alignment with the fixed yarn guide means to its limiting position, for positioning yarn turns on the feed wheel selectively on the rubber-covered axial zone to establish positive feed when the movable yarn guide means of the yarn tension detector is in its said first position and selectively on another zone permitting free rotation of the wheel relative to the yarn turns when the movable yarn guide means of the yarn tension detector is in its limiting position out of alignment with the fixed yarn guide means, the movement of the yarn infeed guide by the lever means being a progressive movement corresponding to the progressive movement of the movable yarn guide means, and a magnetically actuable yarn clamp responsive to the movement of the lever means for clamping the yarn at the infeed side of the feed wheel when the movable yarn guide means is in its limiting position, and releasing the yarn at the infeed side of the feed wheel when a tension in the yarn at the yarn outfeed side of the feed wheel moves the movable yarn guide means from its limiting position.

* * * * *